US009285738B1

(12) United States Patent
Ukawa et al.

(10) Patent No.: US 9,285,738 B1
(45) Date of Patent: Mar. 15, 2016

(54) FIXING DEVICE, IMAGE FORMING APPARATUS, PRESSURE-APPLYING DEVICE, AND PRESSING DEVICE

(71) Applicant: FUJI XEROX CO., LTD., Tokyo (JP)

(72) Inventors: Takayuki Ukawa, Kanagawa (JP); Jun Sawamura, Kanagawa (JP); Hideki Sato, Kanagawa (JP); Yoshiro Konishi, Kanagawa (JP); Yasuhiro Kato, Kanagawa (JP); Masahiro Akatsuka, Kanagawa (JP); Haruhiko Nishida, Kanagawa (JP)

(73) Assignee: FUJI XEROX CO., LTD., Tokyo (JP)

( * ) Notice: Subject to any disclaimer, the term of this patent is extended or adjusted under 35 U.S.C. 154(b) by 0 days.

(21) Appl. No.: 14/829,041

(22) Filed: Aug. 18, 2015

(30) Foreign Application Priority Data

Mar. 19, 2015 (JP) ..... 2015-055506

(51) Int. Cl.
*G03G 15/20* (2006.01)

(52) U.S. Cl.
CPC ..... *G03G 15/2085* (2013.01)

(58) Field of Classification Search
CPC ..... G03G 15/2085
See application file for complete search history.

(56) References Cited

U.S. PATENT DOCUMENTS 3,370,798 A * 2/1968 Hagihara ..... B65H 55/02 235/63 E
5,023,667 A * 6/1991 Negoro ..... G03G 15/164 399/317

FOREIGN PATENT DOCUMENTS

JP 2008-233133 A 10/2008
JP 2011-232442 A 11/2011
JP 2012-177789 A 9/2012

* cited by examiner

*Primary Examiner* — G. M. Hyder
(74) *Attorney, Agent, or Firm* — Sughrue Mion, PLLC

(57) ABSTRACT

A fixing device includes first and second contact bodies that apply a pressure to a recording medium to fix an unfixed image on the recording medium; a pressing member that is movable between a first position at which the pressing member is in contact with the first contact body and a second position at which the pressing member is separated from the first contact body; a first urging member that urges the pressing member to apply a force to the first contact body; a guide member that controls a direction in which the first contact body moves; a second urging member that is interposed between the pressing member and the guide member and that urges the guide member to apply a force to the first contact body; and a changer that selectively changes a position of the pressing member between the first and second positions.

5 Claims, 7 Drawing Sheets

FIXING DEVICE, IMAGE FORMING APPARATUS, PRESSURE-APPLYING DEVICE, AND PRESSING DEVICE

CROSS-REFERENCE TO RELATED APPLICATIONS

This application is based on and claims priority under 35 USC 119 from Japanese Patent Application No. 2015-055506 filed Mar. 19, 2015.

BACKGROUND (i) Technical Field

The present invention relates to a fixing device, an image forming apparatus, a pressure-applying device, and a pressing device.

(ii) Related Art

Electrophotographic image forming apparatuses, for example, generally include a fixing device that fixes an image to a recording medium, such as a paper sheet. The fixing device applies a pressure to the recording medium to fix the image to the recording medium. The fixing device is generally provided with a pressing device, which generates a pressing force by pressing a member that is in contact with the recording medium against the recording medium or another member. There has been a demand for an operational mode in which an envelope is used as the recording medium, and there has also been a demand for a function of setting the pressing force applied in the fixing process such that the pressing force is smaller in an envelope mode, in which an envelope is used as the recording medium, than in a normal mode, in which a paper sheet is used as the recording medium.

SUMMARY

According to an aspect of the invention, there is provided a fixing device including plural contact bodies including a first contact body and a second contact body and having peripheral surfaces that are in contact with each other, the contact bodies applying a pressure to a recording medium by allowing the recording medium to pass through a space between the peripheral surfaces, thereby fixing an unfixed image on the recording medium; a pressing member that applies a force to the first contact body so that the peripheral surface of the first contact body is pressed against the peripheral surface of the second contact body, the pressing member being movable between a first position at which the pressing member is in contact with the first contact body and a second position at which the pressing member is separated from the first contact body; a first urging member that urges the pressing member to apply a force to the first contact body through the pressing member; a guide member having a guide groove that receives a portion of the first contact body to control a direction in which the first contact body moves; a second urging member that is interposed between the pressing member and the guide member and that urges the guide member to apply a force to the first contact body through the guide member; and a changer that selectively changes a position of the pressing member between the first position and the second position.

BRIEF DESCRIPTION OF THE DRAWINGS

An exemplary embodiment of the present invention will be described in detail based on the following figures, wherein.

DETAILED DESCRIPTION

An exemplary embodiment of the present invention will be described with reference to the drawings.

Figure 1:
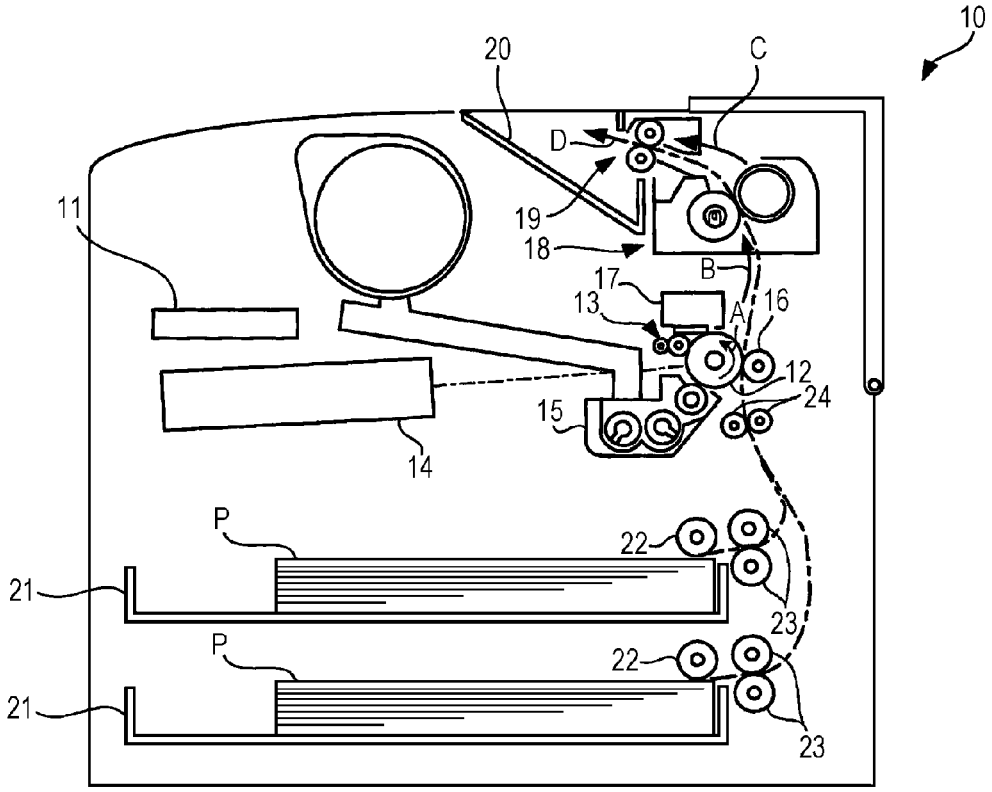
FIG. 1 is a schematic diagram of a printer, which is an example of an image forming apparatus according to an exemplary embodiment of the present invention.

FIG. 1 is a schematic diagram of a printer 10, which is an example of an image forming apparatus according to an exemplary embodiment of the present invention.

The printer 10 illustrated in FIG. 1 is a monochrome printer. An image signal that is created outside the printer 10 and represents an image is input to the printer 10 through a signal cable (not shown) or the like. The printer 10 includes a controller 11 that controls the operation of components included in the printer 10, and the image signal is input to the controller 11. The printer 10 forms an image based on the image signal under the control of the controller 11.

Paper trays 21 are disposed in a lower section of the printer 10. Each paper tray 21 contains a stack of paper sheets P. The paper trays 21 are capable of being pulled out when the paper sheets P are to be supplied thereto. Instead of the paper sheets P, OHP sheets, plastic paper sheets, envelopes, etc., may be contained in the paper trays 21 as recording media according to an exemplary embodiment of the present invention. The operation of the printer 10 will be described with reference to FIG. 1 on the assumption that the paper sheets P are contained. However, the basic operation is the same for the cases in which other recording media are contained.

The paper sheets P contained in the paper trays 21 are transported to standby rollers 24 by pick-up rollers 22 and separation rollers 23. Each paper sheet P that has reached the standby rollers 24 is further transported at an adjusted time.

The printer 10 includes a columnar photoconductor 12 that rotates in the direction shown by arrow A at a location above the standby rollers 24. A charging device 13, an exposure device 14, a developing device 15, a transfer device 16, and a photoconductor cleaner 17 are arranged around the photoconductor 12. The assembly including the photoconductor 12, the charging device 13, the exposure device 14, the developing device 15, and the transfer device 16 is an example of an image-forming unit according to an exemplary embodiment of the present invention.

The charging device 13 charges a surface of the photoconductor 12. The exposure device 14 irradiates the surface of the photoconductor 12 with light in accordance with the image signal transmitted from the controller 11, thereby forming an electrostatic latent image. The electrostatic latent image is developed into a toner image by the developing device 15.

The above-described standby rollers 24 feed the paper sheet P so that the paper sheet P reaches a position where the photoconductor 12 faces the transfer device 16 at a time when the toner image on the photoconductor 12 reaches that position. The transfer device 16 transfers the toner image on the photoconductor 12 onto the paper sheet P that has been fed. Thus, an unfixed toner image is formed on the paper sheet P.

The paper sheet P on which the unfixed toner image is formed is further transported in the direction of arrow B, and a fixing unit 18 fixes the toner image to the paper sheet P by applying heat and pressure to the paper sheet P. As a result, a fixed toner image is formed on the paper sheet P. The fixing unit 18 is an example of a fixing device or a pressure-applying device according to an exemplary embodiment of the present invention.

The paper sheet P that has passed through the fixing unit 18 is further transported toward an output unit 19 in the direction of arrow C, and is ejected to an output tray 20 in the direction of arrow D by the output unit 19.

Figure 2:
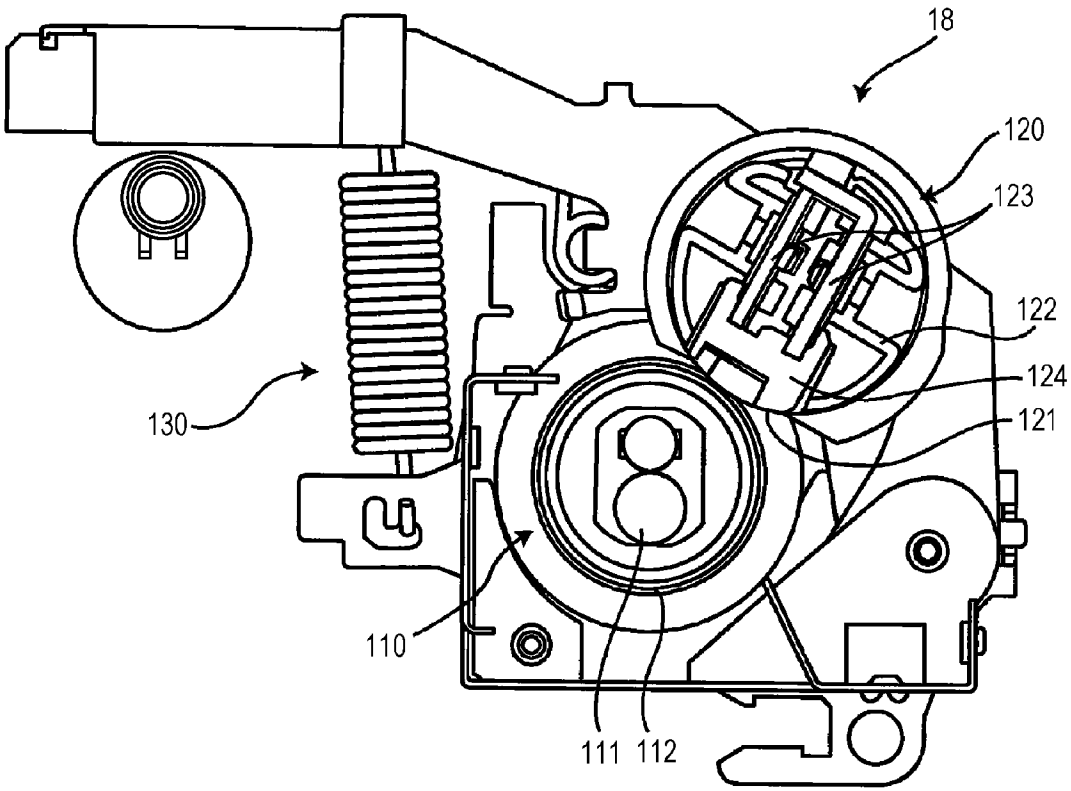
FIG. 2 is a sectional view of a fixing unit.

FIG. 2 is a sectional view of the fixing unit 18.

The fixing unit 18 includes a heating roller 110 and a pressure-applying member 120. The pressure-applying member 120 is an example of a first contact body according to an exemplary embodiment of the present invention, and the heating roller 110 is an example of a second contact body according to an exemplary embodiment of the present invention.

The heating roller 110 includes a heat source lamp 111 and an outer body 112 that is formed by covering a metal core with rubber and that rotates.

The pressure-applying member 120 includes an outer belt 121. A guide 122, support plates 123, and a pressure-applying pad 124 are disposed inside the outer belt 121. The guide 122 is made of a resin, and is configured to guide a rotational movement of the outer belt 121.

The pressure-applying pad 124 presses the outer belt 121 against the heating roller 110 from the inner side of the outer belt 121. The recording medium receives pressure and heat when the recording medium passes through a region (nip region) in which the outer belt 121 is sandwiched between the pressure-applying pad 124 and the heating roller 110 and pressed against the outer surface of the heating roller 110.

The support plates 123 are made of a metal, and support the integrated inner structure of the pressure-applying member 120. When a force is applied to the support plates 123 in a direction toward the heating roller 110, a pressing force that is applied through the pressure-applying pad 124 and the outer belt 121 is generated. The support plates 123 extend beyond the other components of the pressure-applying member 120 at both the near and far ends of the fixing unit 18 in FIG. 2. A pressing mechanism 130 that presses the pressure-applying member 120 against the heating roller 110 through the support plates 123 is assembled to the fixing unit 18 at each end of the fixing unit 18. The pressing mechanisms 130 are an example of a pressing device according to an exemplary embodiment of the present invention.

Figure 3:
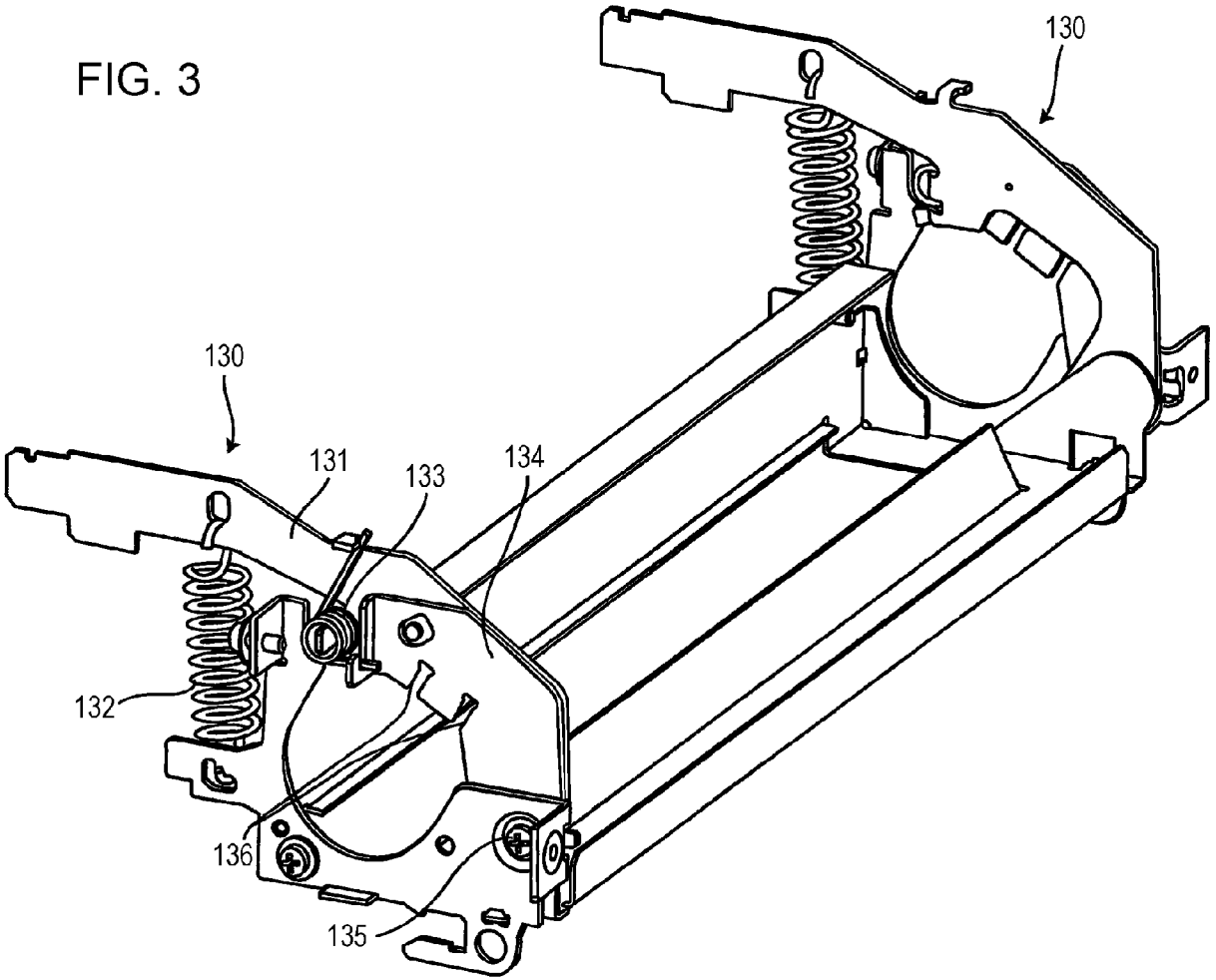
FIG. 3 illustrates the structure of pressing mechanisms.

FIG. 3 illustrates the structure of the pressing mechanisms 130.

Each pressing mechanism 130 includes a pressing plate 131, a normal-mode spring 132, an envelope-mode spring 133, and a guide plate 134. Each pressing mechanism 130 also includes a switch for switching a mode of the pressing mechanism 130. However, the switch is not illustrated in FIG. 3.

The pressing plate 131 is an example of a pressing member according to an exemplary embodiment of the present invention, the normal-mode spring 132 is an example of a first urging member according to an exemplary embodiment of the present invention, the envelope-mode spring 133 is an example of a second urging member according to an exemplary embodiment of the present invention, the guide plate 134 is an example of a guide member according to an exemplary embodiment of the present invention, and the switch is an example of a changer according to an exemplary embodiment of the present invention.

Each of the pressing plate 131 and the guide plate 134 is rotatable around a fulcrum 135.

The guide plate 134 has guide grooves 136 that receive and guide the support plates 123.

The normal-mode spring 132 is attached to the pressing plate 131 at one end thereof so as to urge the pressing plate 131. The envelope-mode spring 133 is retained in a central region of the pressing plate 131, and one end of the envelope-mode spring 133 is attached to the guide plate 134 so as to urge the guide plate 134. Since the envelope-mode spring 133 is disposed between the pressing plate 131 and the guide plate 134, the size of the pressing mechanism 130 is reduced.

The normal-mode spring 132 is a tension spring, and urges the pressing plate 131 downward in FIG. 3. The envelope-mode spring 133 is a torsion spring having a spring constant smaller than that of the normal-mode spring 132, and urges the guide plate 134 downward in FIG. 3.

Figure 4:
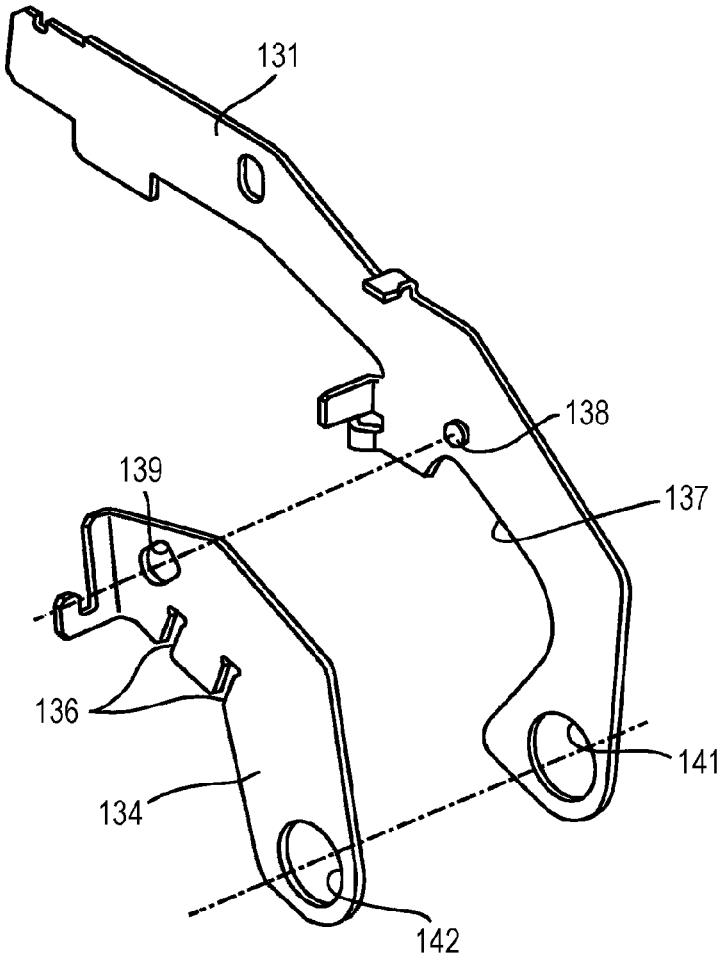
FIG. 4 illustrating the details of a pressing plate and a guide plate.

FIG. 4 illustrates the details of the pressing plate 131 and the guide plate 134.

The pressing plate 131 includes an arch portion 137 that is pressed against the support plates 123 that are received by the guide grooves 136 in the guide plate 134, and a projection 138 that projects toward the guide plate 134. The projection 138 is an example of a contact portion according to an exemplary embodiment of the present invention.

The guide plate 134 has the guide grooves 136 that guide the support plates 123 and a through hole 139 that receives the projection 138 of the pressing plate 131.

The pressing plate 131 and the guide plate 134 respectively have retaining holes 141 and 142 through which the above-described common fulcrum 135 extends to support the pressing plate 131 and the guide plate 134 in a rotatable manner.

The pressing plate 131 and the guide plate 134 are stacked on top of each other and installed in the corresponding pressing mechanism 130, as illustrated in FIG. 3.

In the above-described pressing mechanism 130, a release mode, in which the pressing force is eliminated, may be set in addition to the normal mode and the envelope mode. The state of the pressing mechanism 130 in each mode will now be described.

Figure 5:
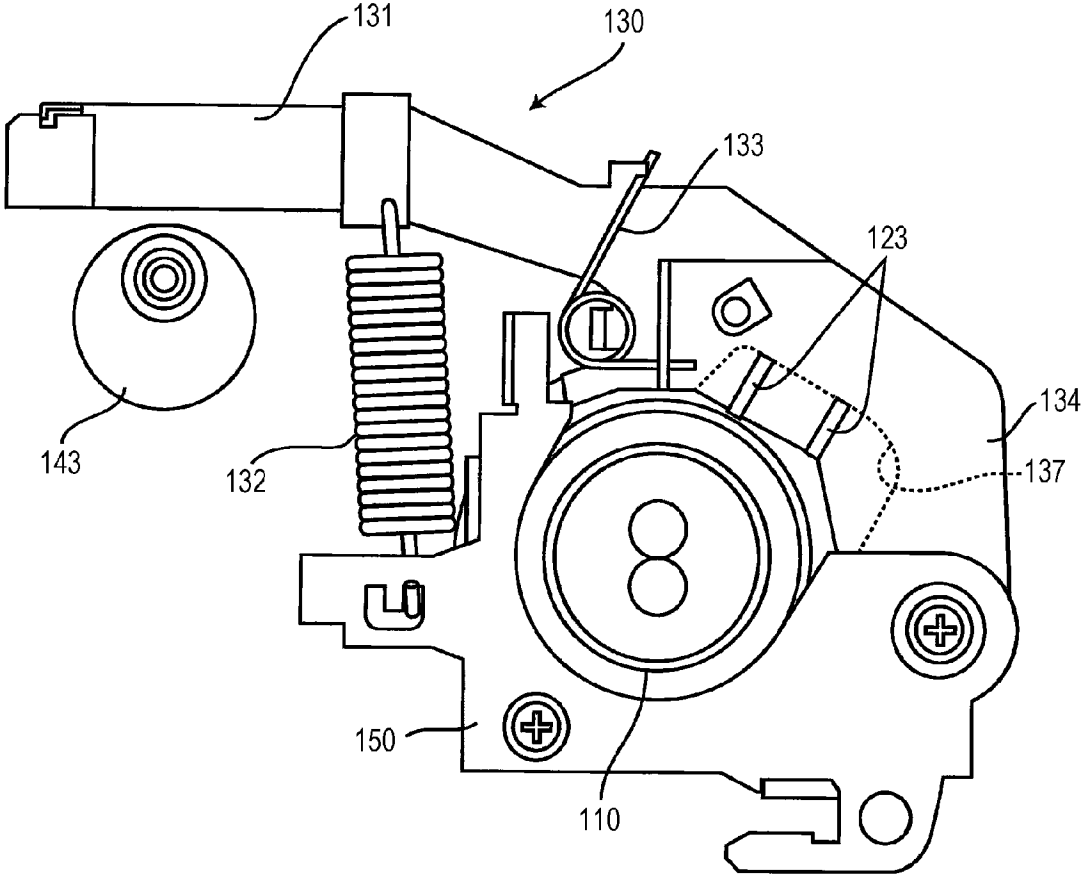
FIG. 5 illustrates the state of a pressing mechanism in a normal mode.

FIG. 5 illustrates the pressing mechanism 130 in a normal mode.

FIG. 5 illustrates a switch 143, which is not illustrated in FIG. 3, and also illustrates the support plates 123 that are guided by the guide plate 134. The above-described heating roller is rotatably supported by a frame 150 of the fixing unit, and the normal-mode spring 132 is attached to the frame 150 and the pressing plate 131.

The switch 143 switches the position of the pressing plate 131 by rotating a rotating cam. The rotation of the rotating cam is controlled by the controller 11 illustrated in FIG. 1. The position of the rotating shaft of the rotating cam is fixed with respect to the frame 150 of the fixing unit. In the normal mode, the rotating cam is separated from the pressing plate 131.

When the rotating cam is separated from the pressing plate 131, the pressing plate 131 is urged downward in FIG. 5 by the normal-mode spring 132, so that the arch portion 137 is pressed against the support plates 123. As a result, a strong force generated by the urging force of the normal-mode spring 132 is applied to the support plates 123, and the recording medium receives a strong pressing force in the above-described nip region.

At this time, the urging force of the envelope-mode spring 133 serves to press the guide plate 134 against the support plates 123. However, since the distance between the pressing plate 131 and the guide plate 134, which are at both ends of the envelope-mode spring 133, does not change, the urging force of the envelope-mode spring 133 does not affect the pressing force applied in the nip region. The direction in which the support plates 123 are pressed by the force generated by the urging force of the normal-mode spring 132 is controlled by the guide plate 134.

When the rotating cam of the switch 143 is rotated from the position in the normal mode illustrated in FIG. 5 so as to raise the pressing plate 131, the pressing mechanism 130 is switched to the envelope mode.

Figure 6:
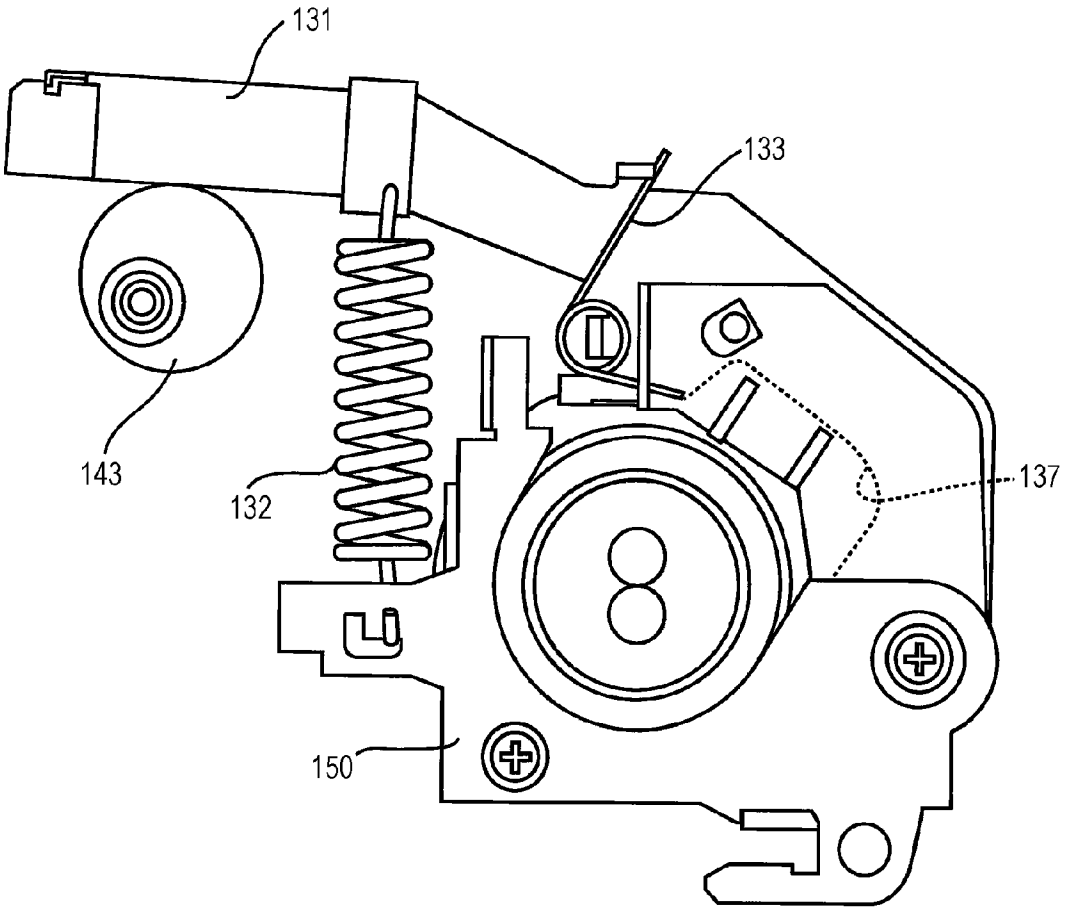
FIG. 6 illustrates the state of the pressing mechanism in an envelope mode.

FIG. 6 illustrates the pressing mechanism 130 in the envelope mode.

When the rotating cam of the switch 143 is rotated so as to raise the pressing plate 131, the position of the pressing plate 131 with respect to the frame 150 of the fixing unit is fixed by the switch 143. In addition, since the pressing plate 131 is raised, the arch portion 137 is separated from the support plates 123. As a result, the urging force of the normal-mode spring 132 serves as a force that presses the pressing plate 131 against the rotating cam of the switch 143, and does not affect the pressing force applied in the nip region.

The urging force of the envelope-mode spring 133 is applied to the guide plate 134, so that the support plates 123 are guided by the guide plate 134 and receive a force from the guide plate 134 at the same time. As a result, in the above-described nip region, the recording medium receives a pressing force based on the urging force of the envelope-mode spring 133, the pressing force being smaller than that applied in the normal mode. The pressing force generated in the nip region differs between the envelope mode and the normal mode. However, in each mode, the support plates 123 are guided by the guide plate 134 in completely the same manner. Therefore, the direction in which the pressing force is applied does not change between the envelope mode and the normal mode. When the pressing force is applied in the same direction, high transportability of the recording medium is ensured in the fixing process.

As described above, according to the present exemplary embodiment, the size of the pressing mechanism 130 is reduced, so that the sizes of the fixing unit 18 and the printer 10 are reduced accordingly. In addition, the pressing force is changeable between the normal mode and the envelope mode without changing the direction in which the pressing force is applied. The switching between the normal mode and the envelope mode is performed by switching between a state in which the support plates 123 are in contact with the pressing plate 131 and a state in which the support plates 123 are separated from the pressing plate 131. Therefore, it is not necessary to achieve high accuracy and the rotation of the switch 143 may be readily controlled.

When the rotating cam of the switch 143 is further rotated from the position in the envelope mode illustrated in FIG. 6 so as to further raise the pressing plate 131, the pressing mechanism 130 is switched to the release mode.

Figure 7:
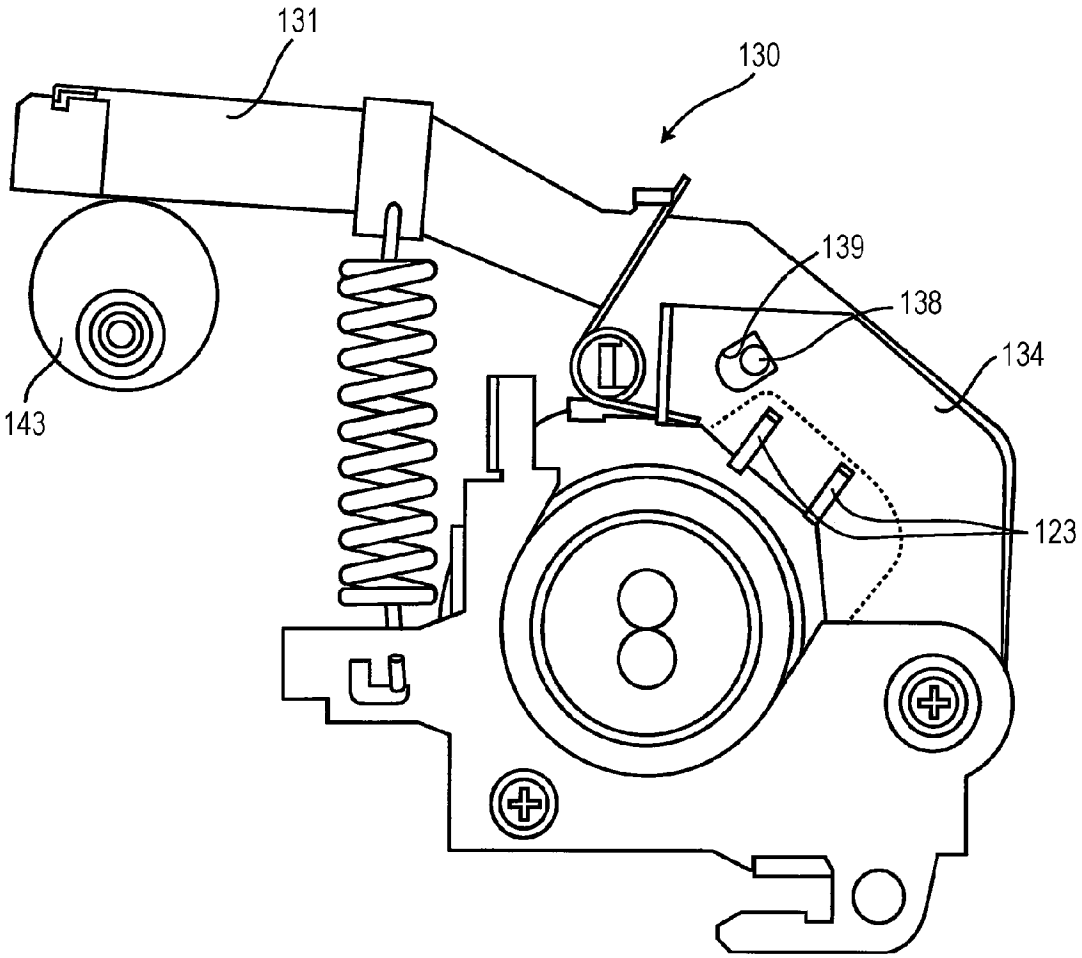
FIG. 7 illustrates the state of the pressing mechanism in a release mode.

FIG. 7 illustrates the pressing mechanism 130 in the release mode.

In the release mode, the pressing plate 131 is raised by the switch 143 to a position higher than that in the envelope mode. Accordingly, the projection 138 of the pressing plate 131 comes into contact with an edge of the through hole 139 in the guide plate 134, so that the guide plate 134 is also raised. As a result, spaces are generated between the guide plate 134 and the support plates 123, and the pressing force applied by the pressing mechanism 130 is eliminated. The release mode is selected when, for example, a paler jam occurs.

As described above, in the present exemplary embodiment, the release mode is realized by a simple structure in which the guide plate 134 is separated from the support plates 123 by bringing the pressing plate 131 and the guide plate 134 into contact with each other. Thus, switching between the three modes, which are the normal mode, the envelope mode, and the release mode, is realized by switching the position of the pressing plate 131 with the switch 143.

Although the controller 11 controls the switch to perform switching between the modes in the above-described description, the switching between the modes may instead be performed manually according to an exemplary embodiment of the present invention.

In addition, although the three modes, that is, the normal mode, the envelope mode, and the release mode, are described above, the structure may instead be such that only the normal mode and the envelope mode are provided and the release mode is not provided according to an exemplary embodiment of the present invention.

In addition, although a fixing unit is described as an example of a pressure-applying device according to an exemplary embodiment of the present invention, the pressure-applying device according to an exemplary embodiment of the present invention may instead be, for example, a device for decurling a paper sheet.

In addition, although a monochrome printer is described in the above exemplary embodiment, the present invention may instead be applied to a color apparatus, a facsimile machine, a copier, or a multifunction machine.

In addition, although an apparatus that forms a toner image by an electrophotographic method is described in the above exemplary embodiment, an image forming unit according to an exemplary embodiment of the present invention may form a toner image on a recording medium by a method other than the electrophotographic method.

The foregoing description of the exemplary embodiment of the present invention has been provided for the purposes of illustration and description. It is not intended to be exhaustive or to limit the invention to the precise forms disclosed. Obviously, many modifications and variations will be apparent to practitioners skilled in the art. The embodiment was chosen and described in order to best explain the principles of the invention and its practical applications, thereby enabling others skilled in the art to understand the invention for various embodiments and with the various modifications as are suited to the particular use contemplated. It is intended that the scope of the invention be defined by the following claims and their equivalents.

What is claimed is:

1. A fixing device comprising:

a plurality of contact bodies including a first contact body and a second contact body and having peripheral surfaces that are in contact with each other, the contact bodies applying a pressure to a recording medium by allowing the recording medium to pass through a space between the peripheral surfaces, thereby fixing an unfixed image on the recording medium;

a pressing member that applies a force to the first contact body so that the peripheral surface of the first contact body is pressed against the peripheral surface of the second contact body, the pressing member being movable between a first position at which the pressing member is in contact with the first contact body and a second position at which the pressing member is separated from the first contact body;

a first urging member that urges the pressing member to apply a force to the first contact body through the pressing member;

a guide member having a guide groove that receives a portion of the first contact body to control a direction in which the first contact body moves;

a second urging member that is interposed between the pressing member and the guide member and that urges the guide member to apply a force to the first contact body through the guide member; and a changer that selectively changes a position of the pressing member between the first position and the second position.

2. The fixing device according to claim 1, wherein the pressing member is movable to a third position that is further away from the first contact body than the second position is, and includes a contact portion that comes into contact with the guide member and separates the guide member from the first contact body when the pressing member moves from the second position to the third position, and wherein the changer selectively changes the position of the pressing member between the first position, the second position, and the third position.

3. An image forming apparatus comprising:

an image forming unit that forms an unfixed image on a recording medium;

a plurality of contact bodies including a first contact body and a second contact body and having peripheral surfaces that are in contact with each other, the contact bodies applying a pressure to the recording medium by allowing the recording medium to pass through a space between the peripheral surfaces, thereby fixing the image;

a pressing member that applies a force to the first contact body so that the peripheral surface of the first contact body is pressed against the peripheral surface of the second contact body, the pressing member being movable between a first position at which the pressing member is in contact with the first contact body and a second position at which the pressing member is separated from the first contact body;

a first urging member that urges the pressing member to apply a force to the first contact body through the pressing member;

a guide member having a guide groove that receives a portion of the first contact body to control a direction in which the first contact body moves;

a second urging member that is interposed between the pressing member and the guide member and that urges the guide member to apply a force to the first contact body through the guide member; and a changer that selectively changes a position of the pressing member between the first position and the second position.

4. A pressure-applying device comprising:

a plurality of contact bodies including a first contact body and a second contact body and having peripheral surfaces that are in contact with each other, the contact bodies applying a pressure to an object by allowing the object to pass through a space between the peripheral surfaces;

a pressing member that applies a force to the first contact body so that the peripheral surface of the first contact body is pressed against the peripheral surface of the second contact body, the pressing member being movable between a first position at which the pressing member is in contact with the first contact body and a second position at which the pressing member is separated from the first contact body;

a first urging member that urges the pressing member to apply a force to the first contact body through the pressing member;

a guide member having a guide groove that receives a portion of the first contact body to control a direction in which the first contact body moves;

a second urging member that is interposed between the pressing member and the guide member and that urges the guide member to apply a force to the first contact body through the guide member; and a changer that selectively changes a position of the pressing member between the first position and the second position.

5. A pressing device comprising:

a pressing member that applies a force to a first contact body so that a peripheral surface of the first contact body is pressed against a peripheral surface of a second contact body, the first contact body and the second contact body being included in a plurality of contact bodies having peripheral surfaces that are in contact with each other, the pressing member being movable between a first position at which the pressing member is in contact with the first contact body and a second position at which the pressing member is separated from the first contact body;

a first urging member that urges the pressing member to apply a force to the first contact body through the pressing member;

a guide member having a guide groove that receives a portion of the first contact body to control a direction in which the first contact body moves;

a second urging member that is interposed between the pressing member and the guide member and that urges the guide member to apply a force to the first contact body through the guide member; and a changer that selectively changes a position of the pressing member between the first position and the second position.

* * * * *